US005587225A

United States Patent [19]

Griesbach et al.

[11] Patent Number: 5,587,225

[45] Date of Patent: Dec. 24, 1996

[54] KNIT-LIKE NONWOVEN COMPOSITE FABRIC

[75] Inventors: Henry L. Griesbach, Atlanta; Christopher C. Creagan, Marietta; Sharon W. Gwaltney, Woodstock, all of Ga.

[73] Assignee: Kimberly-Clark Corporation, Neenah, Wis.

[21] Appl. No.: 430,206

[22] Filed: Apr. 27, 1995

[51] Int. Cl.[6] ..... B32B 27/14

[52] U.S. Cl. ..... 428/198; 428/284; 428/287; 428/296; 428/297; 428/298; 428/299; 428/373

[58] Field of Search ..... 428/198, 296, 428/297, 298, 299, 373, 284, 287

[56] References Cited

U.S. PATENT DOCUMENTS

| | | |
|---|---|---|
| 3,033,721 | 5/1962 | Kalwaites . |
| 3,330,009 | 7/1967 | Hynek . |
| 3,485,706 | 12/1969 | Evans . |
| 3,493,462 | 2/1970 | Bunting, Jr. et al. . |
| 3,494,821 | 2/1970 | Evans . |
| 3,620,903 | 11/1971 | Bunting, Jr. et al. . |
| 3,846,158 | 11/1974 | Vasilyadis . |
| 4,041,203 | 8/1977 | Brock et al. . |
| 4,144,370 | 3/1979 | Boulton . |
| 4,442,161 | 4/1984 | Kirayoglu et al. . |
| 4,537,822 | 8/1985 | Nanri et al. . |
| 4,542,060 | 9/1985 | Yoshida et al. . |
| 4,755,421 | 7/1988 | Manning et al. . |
| 4,808,467 | 2/1989 | Suskind et al. . |
| 4,818,600 | 4/1989 | Braun et al. . |
| 4,902,564 | 2/1990 | Israel et al. . |
| 4,931,355 | 6/1990 | Radwanski et al. . |
| 4,950,531 | 8/1990 | Radwanski et al. . |
| 4,970,104 | 11/1990 | Radwanski . |
| 5,023,130 | 6/1991 | Simpson et al. . |
| 5,106,457 | 4/1992 | Manning . |
| 5,151,320 | 9/1992 | Homonoff et al. . |
| 5,236,771 | 8/1993 | Groshens . |
| 5,284,703 | 2/1994 | Everhart et al. . |
| 5,355,565 | 10/1994 | Baravian . |
| 5,389,202 | 2/1995 | Everhart et al. . |

FOREIGN PATENT DOCUMENTS

| | | |
|---|---|---|
| 0308320 | 3/1989 | European Pat. Off. . |
| 0108621 | 5/1994 | European Pat. Off. . |

*Primary Examiner*—James J. Bell
*Attorney, Agent, or Firm*—Michael U. Lee

[57] ABSTRACT

The present invention provides a durable, launderable hydroentangled composite that is highly suitable for skin-contacting uses. The composite is a hydrogentangled composite which is pattern bonded. The composite contains two filamentous web layers containing crimped continuous filaments and a cellulosic layer containing cellulosic fibers, and the cellulosic layer is disposed between the filamentous web layers. The composite fabric is launderable as demonstrated by the fact that the composite loses less than about 2% of its opacity, based on the initial opacity of the composite, when subjected to one laundering cycle in accordance with the ASTM 2724-87 washing and drying procedure. Additionally provided is a process for producing the composite.

17 Claims, 1 Drawing Sheet

KNIT-LIKE NONWOVEN COMPOSITE FABRIC

BACKGROUND OF THE INVENTION

The present invention is related to a durable hydroentangled nonwoven composite fabric containing pulp fibers and continuous filaments.

Hydroentangling processes and hydroentangled composite webs containing various combinations of different fibers are known in the art. A typical hydroentangling process utilizes high pressure jet streams of water to entangle fibers and/or filaments to form a highly entangled consolidated fibrous structure, e.g., a nonwoven fabric. Hydroentangled nonwoven fabrics of staple length fibers and continuous filaments are disclosed, for example, in U.S. Pat. No. 3,494,821 to Evans and U.S. Pat. No. 4,144,370 to Bouolton. Hydroentangled composite nonwoven fabrics of a continuous filament nonwoven web and a pulp layer are disclosed, for example, in U.S. Pat. No. 5,284,703 to Everhart et al. and U.S. Pat. No. 4,808,467 to Suskind et al. The high pulp content nonwoven fabric of U.S. Pat. No. 5,284,703 is strong and abrasion resistant as well as has a high capacity for absorbing aqueous liquids and oils, making the fabric highly suitable for, e.g., heavy duty wipe applications.

The prior art hydroentangled composite materials are suitable for various uses, they are typically adapted for non-multiple use disposable applications and are not designed to be launderable. When hydroentangled composites are machine laundered, they tend to lose significant amounts of the component fibers and form clumps of bunched fibers, forming composites that have a highly nonuniform fiber coverage. There remains a need for durable hydroentangled composite materials that can be used in multiple wash and use applications.

SUMMARY OF THE INVENTION

The present invention provides a durable, launderable hydroentangled composite that is pattern bonded. The composite contains two filamentous web layers containing crimped continuous filaments and a cellulosic layer containing cellulosic fibers. The cellulosic layer is disposed between the filamentous web layers. The composite fabric is launderable as demonstrated by the fact that the composite loses less than about 2% of its opacity, based on the initial opacity of the composite, when subjected to one laundering cycle in accordance with the ASTM 2724-87 washing and drying procedure.

Additionally provided is a process for forming the durable composite fabric. The process has the steps of providing a layered structure that has a first filamentous layer of crimped filaments, a second filamentous layer of crimped filaments, and a cellulosic layer disposed between the first and second filamentous layers; hydroentangling the layered structure to form a joined laminate; and pattern bonding the joined laminate to form the composite, wherein the composite loses less than about 2% of its opacity, based on the initial opacity of the composite, when subjected to one laundering cycle in accordance with the ASTM 2724-87 washing and drying procedure.

The composite fabric is highly suitable for use in skin-contacting applications since the fabric has soft cloth-like textural and visual properties and is absorbent and breathable.

The term "launder" as used herein indicates subjecting a composite to at least one complete cycle of machine washing and tumble drying processes in accordance with ASTM 2724-87. The change in the uniformity of the composite is measured by the change in the opacity of a composite. Opacity is measured by a "contrast-ratio" method, based on the observation that the reflectance of a fabric, when combined with a white backing, is higher than when it is combined with a black backing. This method measures the color values of a given fabric using a tristimulus colormeter with an "A "-type sensor and illumination provided by a standard CIE source C (simulated overcast sky light), such as Hunter Lab model D25A-9, D25APC2-or D25DP9000 from Hunter Associates Laboratory, Restor, VA. The instrument is standardized with white (89% reflectance) and black (100% absorbance) tiles. The specimen is then placed on the optical sensor and the color values relative to the white perfect diffuser is noted. The decrease in the opacity value indicates that portions of the fibers of the fabric are lost or rearranged, indicating that the fabric developed a non-uniform fiber coverage and/or perforations. The opacity measures the level of light that is prevented from being transmitted through a test specimen composite. Consequently, the level of decrease in opacity measures the level of thinned sections and/or holes that were developed in the composite during the laundering cycle.

DETAILED DESCRIPTION OF THE INVENTION

Figure 1:
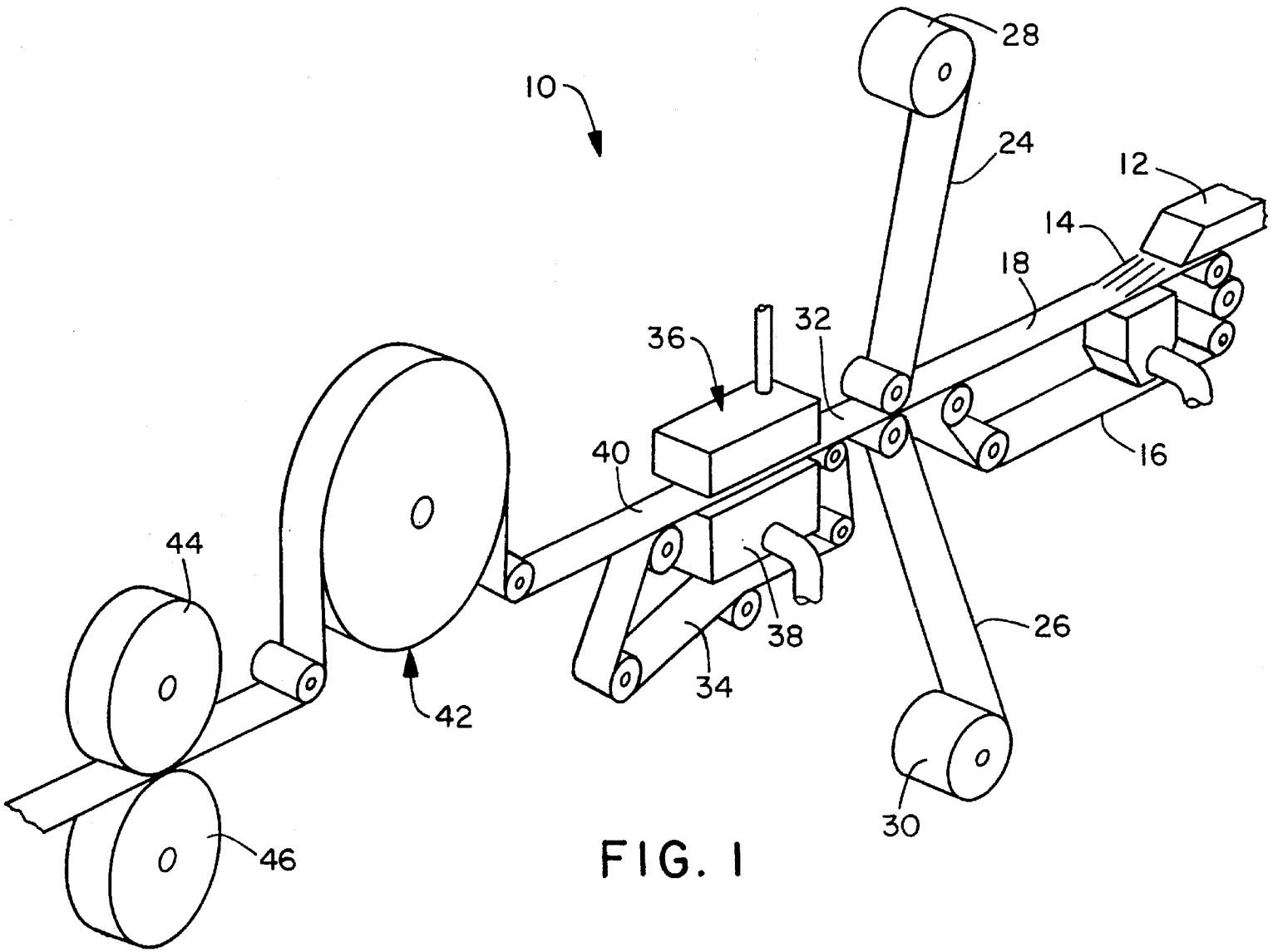
FIG. 1 illustrates an exemplary process for producing the durable composite of the present invention.

The present invention provides a durable, launderable nonwoven composite fabric that exhibits cloth-like textural, visual and absorbent properties, more particularly, cotton knit-like properties. The durable nonwoven composite has at least two web layers of crimped continuous filaments and at least one layer of cellulosic material, and the composite contains, based on the total weight of the composite, between about 40% and about 85%, desirably between about 50% and about 80%, more desirably between about 60% and about 75%, of the filamentous web layers; and between about 60% and about 15%, desirably between about 50% and about 20%, more desirably between about 40% and about 25%, of the cellulosic layer. The present composite is soft, drapable, durable and launderable, as well as liquid absorbent and breathable. In addition to these useful properties, the composite provides limited stretch and recovery characteristics that are akin to a cotton knit fabric, making the composite highly suitable for human skin-contacting applications. Exemplary products that can be produced from the durable composite include tee shirts, underwear, sleeping wear, parts for various disposable articles, e.g., diapers, training pants, sanitary napkins, protective garments and drapes, and the like.

Unlike prior art hydroentangled composites, the composite of the present invention retains the uniform fiber coverage and does not lose a significant amount of its component materials, particularly the cellulosic fibers, when the composite is machine washed and dried in typical commercial or domestic washing and drying machines. In general, the loss of the component materials can be measured in weight loss of the composite, and the present composite does not lose more than 5 weight %, desirably not more than 3 weight %, more desirably not more than 2 weight based on the initial composite weight, per laundering cycle. As indicated above, the loss of the uniform fiber coverage can be measured in deterioration of the opacity of the composite, and the present composite has a decrease in opacity of less than about 2%, desirably less than about 1.5%, more desirably less than 1%, based on the initial composite opacity, per laundering cycle. Most desirably, the opacity of the composite is not decreased by the laundering cycle.

Web materials suitable for each of the filamentous web layers of the present invention include unbonded webs of crimped continuous filaments that have a basis weight between about 15 grams per square meter (gsm) and about 50 gsm, desirably between about 20 gsm and about 35 gsm. It has been found that crimped continuous filaments have a filamentous structure that is particularly suitable for producing the hydroentangled composite of the present invention. The term "unbonded web" mas used herein refers to a unbonded web or embossed web of continuous filaments. The term "embossed" as used herein indicates having consolidated regions that are imparted on a filamentous web to facilitate proper handling, e.g., conveying and storing, of the web. The embossed regions of the filamentous web should be pulled apart and disrupted by the application of jet streams of the hydroentangling process, allowing the filaments to have freedom of movements and ensuring proper entanglement of the filamentous web layers and the cellulosic layer. Consequently, an embossing process provides regions of temporary consolidation in the filamentous web while a bonding process provides regions of permanent interfiber cohesion or bond. The term "continuous filaments" as used herein indicates filaments having a length equal to or longer than about 15 cm, i.e., significantly longer than conventional staple fibers. Most desirably, the continuous filaments have a length that is sufficiently long as to cover the entire length of the filamentous web.

The filamentous webs of crimped continuous filaments can be produced from any fiber-forming thermoplastic polymers. Suitable filaments are monocomponent filaments of a thermoplastic polymer or a blend of more than one thermoplastic polymers. Additionally suitable filaments are multicomponent conjugate filaments that contain at least two component polymers which occupy distinct cross-sections of the filament along substantially the entire length of the filament and multicomponent filaments that contain discrete fibrils of one or more of component polymers within a filamentous polymer matrix. Thermoplastic polymers suitable for the continuous filaments include polyolefins, polyesters, polyamides, and copolymers and blends thereof. Polyolefins suitable for the conjugate fibers include polyethylene, e.g., high density polyethylene, medium density polyethylene, low density polyethylene and linear low density polyethylene; polypropylene, e.g., isotactic polypropylene, syndiotactic polypropylene, blends thereof, and blends of isotactic polypropylene and atactic polypropylene; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Polyamides suitable for the conjugate fibers include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polybuthylene terephthalate, polytetramethylene terephthalate, polycyclohexylene-1,4-dimethylene terephthalate, and isophthalate copolymers thereof, as well as blends thereof. Of these suitable polymers, more desirable polymers are polyolefins, most desirably polyethylene and polypropylene, because of their commercial availability and importance, as well as their chemical and mechanical properties.

Suitable filaments for the present composite have at least about 2 crimps per extended inch, desirably between about 2 and about 50 crimps per extended inch, more desirably between about 3 and about 30 crimps per extended inch, as measured in accordance with ASTM D-3937-82. Desirably, the crimps are helical crimps. Crimps in the filaments can be imparted during the filament spinning process or after the filaments are fully formed, or by selecting a polymer composition or polymer compositions that have spontaneous crimpability when they are processed into filaments.

Crimps in monocomponent and conjugate filaments can be imparted by mechanically crimping fully formed filaments. As is known in the art, mechanical crimping devices, including, gear crimpers and stuffer boxes, can be used to impart crimps. Alternatively, crimps in filaments, especially filaments containing polypropylene, can be imparted during the filament spinning process by asymmetrically cooling the filaments across the cross-section while the spun filaments are being drawn and solidified. Such asymmetric cooling process generates a differential contraction within the cross-section of the spun filaments, causing crimps therein.

Yet another process for crimping filaments is highly suitable for conjugate filaments. This process utilizes latent crimpability of conjugate filaments. When the component polymers for conjugate filaments are selected to have different crystallization and/or shrinkage properties, the resulting filaments contain heat activatable latent crimpability. The crystallization/shrinkage disparity among the component polymers of conjugate filaments, which may result from further crystallization and densification or from relaxation of residual stress, causes the filaments to crimp when the component polymers of the filaments are allowed to further crystallize or relax. Exemplary processes for producing highly suitable conjugate fibers having such latent crimpability and filamentous nonwoven webs produced therefrom are disclosed in commonly assigned U.S. Pat. No. 5,382,400 to Pike et al., which in its entirety is herein incorporated by reference. Although U.S. Pat. No. 5,382,400 discloses bonded spunbond filamentous webs, suitable filamentous webs for the present invention are obtained when the bonding step disclosed therein is omitted. Suitable polymers for the multicomponent conjugate filaments are selected from the above-listed thermoplastic polymers. For example, for two-component conjugate filaments (bicomponent filaments), suitable polymer pairs include Polyethylene-polypropylene, Polyethylene-polyamide, polyethylene-polyester, polypropylene-polyamide, polypropylene-polyester and the like. More specifically, desirably suitable pairs include high density polyethylene-propylene, linear low density polyethylene-polypropylene, high density polyethylene-nylon 6, high density polyethylene-nylon 6/6, linear low density polyethylene-nylon 6, linear low density polyethylene-nylon 6/6, high density polyethylene-polyethylene terephthalate and linear low density polyethylene-polyethylene terephthalate.

Suitable continuous crimped filaments have an average diameter between about 10 μm and about 50 μm, desirably between about 15 μm and about 30 μm. The continuous filaments may have a cross-sectional configuration other than conventional circular shapes, e.g., a bilobal, trilobal, rectangular or oval configuration.

In accordance with the present invention, various wood and nonwood pulps and other cellulosic fibers may be incorporated into the composite as the cellulosic layer, and the pulps may be a mixture of different types and/or qualities of pulp fibers. However, wood pulps of long, flexible fibers that have a low coarseness index are more useful for the cellulosic layer of the present invention. Illustrative examples of suitable pulps include southern pines, northern softwood kraft pulps, red cedar, hemlock, eucalyptus, black spruce and mixtures thereof. Exemplary commercially available long pulp fibers suitable for the present invention include those available from Kimberly-Clark Corporation under the trade designation Longlac-19, Coosa River-54, Coosa River-56 and Coosa River-57. The cellulosic layer may also contain a minor amount of hydrophilic synthetic fibers, e.g., rayon fibers and ethylene vinyl alcohol copolymer fibers, and hydrophobic synthetic fibers, e.g., polyolefin fibers. Desirably, the cellulosic layer has a basis weight between about 10 gsm and about 50 gsm, more desirably between about 15 gsm and about 30 gsm.

Referring to FIG. 1, there is illustrated a process 10 for producing a durable, knit-like composite of the present invention. A dilute suspension of pulp fibers in water is supplied by a head-box 12 and deposited via a sluice 14 in a uniform dispersion onto a forming fabric 16 of a papermaking machine, and then water is removed from the suspension to form a uniform cellulosic layer of pulp fibers 18. The suspension may be diluted to any consistency that is typically used in conventional papermaking processes. For example, the suspension may contain from about 0.1% to about 1.5% by weight pulp fibers suspended in water. Alternatively, the cellulosic layer 18 may be separately preformed into a sheet or roll of pulp fibers.

The cellulosic layer 18 is then placed between two layers of crimped filamentous webs 24 and 26, which are unwound from supply rolls 28 and 30, respectively, to form a unitary composite structure 32. Although FIG. 1 illustrates that the web layers 24 and 26 are preformed, the web layers can be produced in line. As discussed above, the web layers are unbonded or embossed webs of crimped continuous filaments.

The composite structure 32 is then laid on a foraminous entangling surface 34 of a hydroentangling machine. The composite structure 32 is treated with jets of fluid, typically water, to entangle the layers of the composite. Hydroentangling processes are known in the art, and for example, U.S. Pat. No. 3,485,706 to Evans discloses a suitable hydroentangling process, which patent is hereby incorporated by reference. The invention may be practiced, for example, utilizing a manifold 36 produced by Honeycomb Systems incorporated, Biddeford, Maine, containing a strip having 0.18 millimeter diameter orifices, 12 holes per centimeter and 1 row of holes. A working fluid, typically water, is passed through the orifices at a pressures ranging from about 14 to about 140 kilograms per square centimeter gage, desirably from about 35 to 130 kilograms per square centimeter gage. The working fluid impacts the composite 32, which is supported by the foraminous surface 34, and causes thorough entangling and interlocking of the crimped filaments of the filamentous web layers and the pulp fibers of the cellulosic layer. The hydroentangling process may employ a vacuum apparatus 38, which is placed directly underneath the foraminous surface 34 where the hydroentangling manifold 36 is located, such that the working fluid is withdrawn from the hydroentangled composite 40. The foraminous surface 34 can be of a variety of sizes and configurations including a single plane mesh having a mesh size of from about 10×10 to about 100×100 or a multiply mesh having a mesh size of from about 50×50 to about 200×200.

Although FIG. 1 illustrates that the hydroentangling process is applied from only one side of the composite, it is more desirable to apply the hydroentangling process on both sides of the composite to produce a composite having substantially indistinguishable sides. The hydroentangling process can also be used to impart a patterned effect that creates apertures in the fabric, for example, as disclosed in U.S. Pat. No. 3,033,721 to Kalwaites.

After hydroentangling the composite, the composite 40 is dried. Desirably, the composite is dried without applying compression. The composite may be dried utilizing, for example, a rotary drum through-air drying apparatus 42. The drying apparatus 42 has an outer, perforated surface that supports the composite and allows heated air to go through the perforated surface onto the composite, removing the residual working fluid and moisture from the composite.

In accordance with the present invention, the dried hydroentangled composite is pattern bonded to form uniformly or substantially uniformly distributed bonded regions, imparting durability and launderability as well as imparting additionally desirable textural properties, e.g, knit-like and woven textures, without significantly changing the physical properties, such as drapability and softness, of the hydroentangled composite. The phrase substantially uniformly distributed bonded regions as used herein indicates that the bonded regions may not be perfectly uniformly distributed but are not grossly clustered as to form large unbonded regions. More particularly, the phrase substantially uniformly distributed bonded regions indicates that the distance between adjacent bonded regions of a bonded composite is not larger than 10 times, desirably not larger than 5 times, the width of the largest dimension of the bonded regions. Suitable bonding methods include autogenous bonding processes and adhesive bonding processes. More desirable bonding processes for the present invention are autogenous bonding processes since autogenous bonding processes do not require additional materials, e.g., extraneous adhesives, and production steps, e.g., adhesive applying and curing steps. In general, an autogenous pattern bonding process employs pattern bonding roll pairs, e.g., 44 and 46 of FIG. 1, for effecting substantially uniformly distributed bonded regions at limited areas of the composite by passing the composite through the nip formed by the bonding rolls. One or both of the roll pair are heated to an appropriate temperature and have a pattern of lands and depressions on the surface, which effects the bonded regions. Alternatively, the bond pattern can be applied by passing the web through a gap formed by an ultrasonic work horn and anvil.

The temperature of the bonding rolls and the nip pressure should be selected so as to effect bonds without having undesirable accompanying side effects such as web degradation. In addition, the bonding roll temperature should not be so high as to cause the fabric to stick to the bonding rolls. Alternatively stated, it is not desirable to expose the web to a temperature at which the polymer of the web layers melts excessively, thereby thermally degrading the fabric and allowing the fabric to stick to the bonding rolls. Although appropriate roll temperatures and nip pressures are generally influenced by parameters such as web speed, web basis weight, component polymers and the like, the roll temperature desirably is in the range between the softening point and the crystalline melting point of the component polymer that forms the filaments. For example, desirable bonding roll settings for a web layer that contains polypropylene filaments are a roll temperature in the range of about 125° C. and about 160° C. and a bond point pressure on the fabric in the range of about 350 kg/cm$^2$ and about 3,500 kg/cm$^2$. For a filamentous web layer containing linear low density polyethylene, the suitable bonding roll temperature is between about 120° C. and about 135° C. A suitable laminate bonding process is disclosed in U.S. Pat. No. 4,041,203 to Brock et al., which is herein incorporated by reference.

Suitable adhesive bonding processes for the present invention effect uniformly or substantially uniformly distributed discrete bonded regions using an adhesive. Suitable adhesives include natural and synthetic polymeric latex materials, such as Rhoplex® E-940 and Rhoplex® NW1715, which are available from Rohm and Hass, and Elastoplast® V-29, which is available from B. F. Goodrich. The latex material desirably is applied to the dried, hydroentangled composite as an aqueous solution. The method of application is not critical and largely is a matter of convenience. Thus, the latex solution can be applied by a sprayer, brush, roller or dropper, provided that the selected method of application can deliver the latex solution to predefined discrete regions in the composite. Desirably, the adhesive is applied on both sides of the composite. After the latex solution is applied to the composite, the composite is dried, desirably at an elevated temperature, to remove water and to cure the latex.

In accordance with the present invention, the total area covered by the thermally or adhesively bonded regions occupies between about 10% and 50%, desirably about 15% to about 45%, more preferably about 20% to about 35%, of the planar surface of the composite. Suitable bond patterns include point bond patterns of various shapes, such as circles, diamonds, rectangles, squares, ovals and the like; and line bond patterns of various configurations, such as straight lines, waves, curves and the like. Desirably, when a point bond pattern is employed, the bonded composite contains from about 10 to about 250 bonded points per square centimeter (cm$^2$), more preferably from about 42 to about 234 bonded points per cm$^2$.

The durable, launderable composite of the present invention exhibits cotton knit-like textural and physical properties. The composite is highly suitable for various uses including clothing, protective garments, drapes, covering and the like. The composite is more particularly suitable for skin-contacting applications such as underwear, wipes, bed liners, parts for disposable articles such as diapers and sanitary napkins, and the like.

The following examples are provided for illustration purposes and the invention is not limited thereto.

EXAMPLES

The following testing procedures were used to evaluate the test specimens of the examples.

Weight Loss

The loss of weight of the hydroentangled composite is attributable to the pulp fibers of the cellulosic layer that are disentangled and separated from the composite during the laundering process. The weight loss is the difference between the weight of the composite before laundering and the weight of the composite after laundering.

Bulk

The lower the increase in bulk, the more stably affixed is the pulp fibers and the filaments in the composite. The bulk was measured using an Ames thickness tester Model 3223 equipped a 0.001 inch graduation indicator. A 3 inch diameter platen with total weight of 0.4 pounds, including an attachment rod and weights, was placed on a 4 inch by 4 inch sample, and the bulk was read to the nearest 0.001 inch.

Opacity

Opacity was measured in accordance with the above-described testing procedure.

COMPARATIVE EXAMPLE 1

The following comparative example was conducted to illustrate the importance of crimps in the filaments that form the filamentous layer. A unbonded uncrimped spunbond nonwoven web having a 71 g/m$^2$ (gsm) basis weight was prepared from 3% ethylene–97% propylene copolymer, which was Exxon's 9335 copolymer, in accordance with U.S. Pat. No. 3,802,817 to Matsuki et al. The nonwoven web was then laid on the hydroentangling surface of a hydroentangling apparatus that is illustrated in FIG. 1 and hydrogentangled. The entangling foraminous surface had a size of 100 mesh and the manifolds had one row of 0.006 inch (0.15 mm) diameter holes at a density of 40 holes per inch (16 holes/cm). The energy, more specifically the value of energy times impact (energy-impact), used to hydroentangle the web was about 1.5 megaJoule-Newton per kilogram (MJ-N/kg) as calculated in accordance with the impact-energy product that is disclosed in U.S. Pat. No. 5,023,130 to Simpson et al. The description of the energy-impact value disclosed in U.S. Pat. No. 5,023,130 is herein incorporated by reference.

The hydrogentangled uncrimped filamentous web did not have a uniform and high level of interfiber entanglements and was not well entangled to provide an easily handlable web. The hydroentangled web did not separate easily from the entangling surface.

EXAMPLE 1

Comparative Example 1 was repeated, except the filaments of the unbonded web were crimped during the spinning process by applying an asymmetrical application of quenching air onto the spun filaments just below the spinneret. The resulting unbonded web had a basis weight of 77 gsm. The web was then hydroentangled according the procedure outlined in Comparative Example 1, except the energy-impact value used was about 1.38 MJ-N/kg. The hydrogentangled crimped filamentous web had a uniform and high level of interfiber entanglements, and the hydroentangled web separated easily from the entangling surface.

The hydroentangled webs of the above two examples clearly demonstrate that the crimps in the filaments are highly important for the proper hydroentanglement of filamentous webs.

COMPARATIVE EXAMPLE 2–4

Comparative Examples 2–4 were conducted to demonstrate the short service-life of prior art hydroentangled composites that are produced from a bonded filamentous nonwoven web.

COMPARATIVE EXAMPLE 2 (C2)

A unbonded crimped spunbond nonwoven web having a 22 g/m$^2$ (gsm) basis weight was prepared from side-by-side bicomponent filament of 50 wt % linear low density polyethylene (LLDPE) and 50 wt % polypropylene (PP) using the bicomponent conjugate fiber production process disclosed in the above-mentioned U.S. Pat. No. 5,382,400. LLDPE, Aspun 6811A, which is available from Dow Chemical, was blended with 2 wt % of a $TiO_2$ concentrate containing 50 wt % of $TiO_2$ and 50 wt % of a PP, and the mixture was fed into a first single screw extruder. PP, grade 3445, which is available from Exxon, was blended with 2 wt % of the above-described $TiO_2$ concentrate, and the mixture was fed into a second single screw extruder. The extruded polymers were spun into bicomponent fibers using a side-by-side bicomponent spinning die, which had a 0.6 mm spinhole diameter and a 6:1 L/D ratio. The temperature of the molten polymers fed into the spinning die was kept at 230° C., and the spinhole throughput rate was 0.5 gram/hole/minute. The bicomponent fibers exiting the spinning die were quenched by a flow of air having a flow rate of 0.5 m$^3$/min/cm (45 ft$^3$/min/inch) spinneret width and a temperature of 18° C. The quenching air was applied about 13 cm below the spinneret. The quenched fibers were drawn in an aspirating unit of the type which is described in U.S. Pat. No. 3,802,817 to Matsuki et al., and the aspirating air temperature was about 177° C. The weight-per-unit-length measurement of the drawn fibers was about 2 denier per filament. The drawn fibers were then deposited on a foraminous forming surface to form an unbonded fiber web with the assist of a vacuum apparatus that was placed beneath the forming surface. The filaments had between 2 and 10 crimps/cm.

The unbonded spunbond web was bonded by passing the web through the nip formed by a calender roll and an anvil roll. The calender roll was a steel roll which had a wire weave pattern of regularly spaced raised points on its surface and was equipped with a heating means. The anvil roll was a smooth stainless steel roll and was also equipped with a heating means. Both of the bonding rolls had a diameter of about 61 cm. The bonding pin pressure applied by the bonding rolls on the webs was about 560 kg/cm$^2$, and the rolls were heated to a temperature as indicated in Table 1. The total bonded area of the fabric was about 20% of the total surface area, and each bond point had an oval shape of about 0.4 mm width and 0.85 mm length.

The bonded nonwoven fabric was laid on the hydroentangling surface of a hydroentangling apparatus that is illustrated in FIG. 1, and a layer of a 15 gsm preformed tissue sheet, which contained 50 wt % eucalyptus fibers and 50 wt % Longlac-19 fibers, was laid over the nonwoven fabric. The composite was hydroentangled in accordance with Example 1 with the pulp layer facing the jet stream of the hydroentangling manifold. The energy-impact value used to hydroentangle the composite was about 0.41 MJ-N/kg. The hydroentangled composite was dried, and was tested for its weight, bulk and opacity. The composite was then subjected to one cycle of washing and tumble drying steps in accordance with the procedures outlined in ASTM 2724-87. The laundered composite was again tested for its weight, bulk and opacity. The results are shown in Table 1.

COMPARATIVE EXAMPLE 3 (C3)

A 34 gsm unbonded bicomponent filament nonwoven web was prepared by following the procedure outlined in Comparative Example 2. Then the nonwoven web was bonded by passing the web through a through-air bonder which was equipped with a heated air source. The temperature of the heated air was 262° F. (128° C.). The residence time of the web in the hood was about 1second. The resulting bonded fabric had interfiber bonds at cross-over contact points of the filaments throughout the fabric.

The through-air bonded nonwoven fabric was hydroentangled with a layer of a 34 gsm tissue sheet of the type described in Comparative Example 2 in accordance with the procedure outlined in Comparative Example 2, except the energy-impact value used was about 0.28 MJ-N/kg. The resulting hydroentangled composite was tested for its physical properties, laundered and then tested for its physical properties in accordance with Comparative Example 2. The results are shown in Table 1.

COMPARATIVE EXAMPLE 4(C4)

A hydroentangled composite was produced in accordance with Comparative Example 2 except that an additional bicomponent filament spunbond layer was placed over the pulp layer. The energy-impact value used was about 0.51 MJ-N/kg. Both sides of the composite were subjected to the hydroentangling process in order to produce a hydroentangled composite having two sides that have texturally and visually equal properties. The additional spunbond layer had the same composition and basis weight of the spunbond layer described in Comparative Example 2. The resulting hydroentangled composite was tested for its physical properties, laundered and then tested for its physical properties in accordance with Comparative Example 2. The results are shown in Table 1.

EXAMPLE 2 (Ex2)

A 34 gsm unbonded spunbond nonwoven web and a 27 gsm unbonded nonwoven web of crimped bicomponent filaments were produced and a 30 gsm pulp sheet was prepared in accordance with Comparative Example 4, except the energy-impact value used was about 0.45 MJ-N/kg. A composite of 34 gsm nonwoven web/30 gsm tissue layer/27 gsm nonwoven web was prepared and then hydroentangled in accordance with Comparative Example 4, hydroentangling both sides of the composite. The hydroentangled composite was dried and then pattern bonded using a bonding roll pair of a smooth anvil and a patterned roll. The patterned roll had a total bonding area of about 20%, and each bond point had an oval shape of about 0.04 mm width and 0.025 mm length. The temperature of the roll was 115° C. The anvil was kept at 117° C., and the composite was advanced at 25 feet/min (7.6 m/min). The bonded composite had soft cotton knit-like textural and visual properties.

The hydroentangled, bonded composite was tested for its physical properties, laundered and then tested for its physical properties in accordance with Comparative Example 2. Additionally, the composite was subjected to five cycles of washing and drying and then tested. The results are shown in Table 1.

EXAMPLE 3(Ex3)

Example 2 was repeated except the bonding roll had a bonding pattern of parallel laid lines in the machine direction. The bonding lines had a 0.25 mm width and the total area of the bonded regions was about 20% . Again, the composite had cloth-like, specifically cotton knit-like, properties. The bonded composite was tested for its properties, and then laundered. The laundered composite was tested again for its properties. The results are shown in Table 1.

COMPARATIVE EXAMPLE 5 (C5)

A unbonded hydroentangled composite, i.e., hydroentangled but not pattern bonded, composite produced in Example 2 was tested for its properties, and then laundered. The laundered composite was again tested for its properties. The results are shown in Table 1.

EXAMPLE 4 (Ex4)

Example 2 was repeated except a lower basis weight pulp layer was utilized. The pulp layer had a 15 gsm basis weight, and the energy-impact value used to hydroentangle the composite was about 0.53 MJ-N/kg. The results are shown in Table 1.

EXAMPLE 5 (Ex5)

Example 4 was repeated, except the bonding pattern of Example 3 was used. The tissue layer had a 15 gsm basis weight. The results are shown in Table 1.

COMPARATIVE EXAMPLE 6 (C6)

A unbonded hydroentangled composite produced in Example 4 was tested for its physical properties, and then laundered. The laundered composite was again tested for its physical properties. The results are shown in Table 1.

EXAMPLE 6 (Ex6)

Example 4 was repeated except both bicomponent filament web layers had a 27 gsm basis weight and the energy-impact value used was about 0.89 MJ-N/kg. The results are shown in Table 1.

EXAMPLE 7 (Ex7)

Example 6 was repeated except the bonding pattern of Example 3 was used to bond the composite. The results are shown in Table 1.

COMPARATIVE EXAMPLE 7 (C7)

A unbonded hydroentangled composite produced in Example 6 was tested for its physical properties, and then laundered. The laundered composite was again tested for its physical properties. The results are shown in Table 1.

EXAMPLE 8 (Ex8)

A hydroentangled composite was produced in accordance with Example 6, except the energy-impact value used was about 0.86 Mj-N/kg. The composite was adhesively bonded using a latex, National Starch's Nacrylic X-8404, thickened with Rhom and Hass' Rhoplex ASE-95. The latex was applied on the composite by a groove printing method to form discrete oval bond points that had dimensions of approximately 6 mm in the major axis and 3 mm in the minor axis. The total bond area was about 22%. About 8 wt % of latex solid equivalent, based on the weight of the composite, was applied on each side of the composite, and the latex was cured in an infrared oven. The results are shown in Table 1.

comparative Example 8 (C8)

A unbonded hydroentangled composite produced in Example 8 was tested for its properties. The results are shown in Table 1.

TABLE 1

| | Component Layer Basis Weight (gsm) | | | Total Basis Weight (gsm) | | | | | Opacity | | | | | Bulk (mil) | | |
|---|---|---|---|---|---|---|---|---|---|---|---|---|---|---|---|---|
| | | | | | | % | | % Total | | | % | | % Total | | | % |
| Example | $F_1$ | P | $F_2$ | Pre | $Pst_1$ | Change | $Pst_5$ | Change | Pre | $Pst_1$ | Change | $Pst_5$ | Change | Pre | $Pst_1$ | Change |
| C2 | 22 | 15 | — | 68 | 33 | −51% | — | | 43.5 | 33.8 | −22.3% | — | | 0.46 | 0.71 | 56% |
| C3 | 34 | 34 | — | 37 | 23 | −38% | — | | 65.1 | 35.4 | −45.6% | — | | 0.76 | 1.19 | 57% |
| C4 | 22 | 15 | 22 | 59 | 48 | −18% | — | | 56.4 | 53.3 | −5.5% | — | | 0.69 | 1.55 | 126% |
| Ex 2 | 34 | 30 | 27 | 91 | 90 | −1% | 84 | −8% | 68.7 | 73.4 | 6.8% | 69.7 | 1.5% | 0.38 | 0.56 | 47% |
| Ex 3 | 34 | 30 | 27 | 91 | 90 | −1% | — | | 60.8 | 61.2 | 0.7% | — | | 0.56 | 0.76 | 36% |
| C5 | 34 | 30 | 27 | 91 | 88 | −3% | — | | 70.0 | 68.4 | −2.3% | — | | 0.71 | 1.32 | 86% |
| Ex 4 | 34 | 15 | 27 | 76 | 75 | −1% | — | | 63.7 | 66.4 | 4.2% | — | | 0.38 | 0.64 | 67% |
| Ex 5 | 34 | 15 | 27 | 76 | 75 | −1% | — | | 68.5 | 70.1 | 2.3% | — | | 0.56 | 0.76 | 36% |
| C6 | 34 | 15 | 27 | 76 | 73 | −4% | — | | 64.8 | 60.0 | −7.4% | — | | 0.71 | 1.70 | 139% |
| Ex 6 | 27 | 15 | 27 | 64 | 63 | −2% | — | | 57.4 | 60.1 | 4.7% | — | | 0.56 | 0.84 | 50% |
| Ex 7 | 27 | 15 | 27 | 64 | 63 | −2% | — | | 61.6 | 61.1 | −0.8% | — | | 0.56 | 0.66 | 18% |
| C7 | 27 | 15 | 27 | 64 | 61 | −5% | — | | 57.4 | 55.9 | −2.6% | — | | 0.66 | 2.34 | 254% |
| Ex 8 | 27 | 15 | 27 | 64 | 63 | −2% | — | | 64.3 | 63.2 | −1.7% | — | | 0.58 | 0.99 | 70% |
| C8 | 27 | 15 | 27 | 64 | 61 | −5% | — | | 57.8 | 50.6 | −12.5% | — | | 0.64 | 2.24 | 252% |

Note:
$F_1$ = first filamentous layer
P = cellulosic layer.
$F_2$ = second filamentous layer.
Pre = pre-laundered.
$Pst_1$ = post-laundered one cycle.
$Pst_5$ = post-laundered five cycles.

The composites of the above examples all had a soft cloth-like texture, and when the samples were pattern bonded, the samples exhibited cotton knit-like texture.

The textural, visual and physical properties of the bonded and unbonded samples were evidently distinguishable after they were subjected to the laundering process.

The decrease in basis weight indicates the amount of pulp fibers lost during the laundering cycle, and the decrease in opacity indicates that portions of the fibers forming the composite were grossly rearranged or lost during the laundering cycle while the increase in the opacity indicates that the fibers of the composite were somewhat repositioned to form a composite that has a more uniform or denser pulp fiber coverage. The increase in opacity may indicate that the composite increased its bulk, i.e., fluffed up, while retaining its uniform fiber coverage. It is to be noted that an increase in the bulk measurement for a post-laundered composite does not necessarily indicate improved uniformity of the laundered composite since the bulk measurement can also be increased if the pulp fibers are bunched and clumped at different spots within the composite.

The large decreases in the basis weight for Comparative Examples 2–4 that contain bonded filamentous webs, when compared to other comparative examples that utilize unbonded filamentous webs, clearly demonstrate that the freedom of movement among the filaments of the webs is highly important for firmly affixing or entangling the pulp fibers and the filaments. In addition, the relatively low decreases of the basis weight and opacity shown by Comparative Example 4, compared to Comparative Examples 2–3,illustrate that having two outer layers of a filamentous web, instead of one outer web layer as in Comparative Examples 2–3, significantly improves the stability of the hydroentangled composite.

The basis weight and opacity data for Examples 2–8 and Comparative Examples 5–8 show that the pattern bonding step of producing the present composite significantly improves the durability and launderability of the hydroentangled composite. For example, the composite of Example 2 only lost about 1 weight % of the total composite weight after one laundering cycle, whereas the counterpart unbonded composite lost about 3 weight % during the first laundering cycle. As indicated by the opacity data, the composite of Example 2 substantially retained its uniform fiber coverage and cloth-like textural properties even after the five laundering cycles, but the unbonded composite developed holes and formed regions of clumped cellulosic fibers during the laundering cycle. The durability and stability of the bonded composites were more pronounced when test specimens of a lighter basis weight composite, e.g., Examples 6–7 and Comparative Example 7, were laundered.

Although the bulk change during the laundering cycle is not a direct indicator of durability of the composite, as discussed above, in general, a smaller change in bulk indicates that the fibers of the composite are more cohesively entangled and bonded. The bulk changes between bonded and unbonded composites are dramatically different, as can be seen from the bulk change data of Examples 2–8 and the counterpart unbonded composites, Comparative Examples 5–8.

EXAMPLE 9 (Ex9)

Example 9 and Comparative Examples 9–10, below, were conducted to illustrate the importance of placing the cellulosic layer between outer layers of filamentous webs. A bonded, hydroentangled composite having a high basis weight pulp layer was produced in accordance with Example 6, except the pulp sheet had a 55 , gsm basis weight and the energy-impact value used was about 0.16 MJ-N/kg. It is to be noted that for this example, the pulp layer was placed between the two filamentous layers, and then the composite was hydroentangled and bonded. The bonded composite was subjected to two complete cycles of the laundering process.

The physical properties of the composite are shown in Table 2.

COMPARATIVE EXAMPLE 9 (C9)

A hydroentangled composite was produced following Example 9 except that the pulp layer was placed on top of the two filament web layers, making a two-sided composite. The composite was hydroentangled exposing the pulp layer to the jet stream, and then the composite was bonded in accordance with Example 9 , with its pulp layer exposed to the patterned bonding roll. The physical properties of the composite are shown in Table 2.

COMPARATIVE EXAMPLE 10 (C10)

A bonded, hydroentangled composite was produced following Comparative Example 9, except the filament web layer was exposed to the patterned bonding roll. The physical properties of the composite are shown in Table 2.

TABLE 2

| | Layer Basis Weight (gsm) | | | Total Basis Wt (gsm) | | | Opacity | | |
|---|---|---|---|---|---|---|---|---|---|
| | | | | | | % | | | % |
| Example | 1 | 2 | 3 | Pre | $Pst_2$ | Change | Pre | $Pst_2$ | Change |
| Ex 9 | F26 | P55 | F26 | 107 | 104 | −3% | 76.3 | 77.6 | 2% |
| C9 | F26 | F26 | P55 | 107 | 94 | −12% | 75.9 | 68.7 | −9% |
| C10 | P55 | F26 | F26 | 107 | 88 | −18% | 77.0 | 61.6 | −20% |

Note:
$F_{..}$ = filamentous layer and the weight of the layer.
$P_{..}$ = cellulosic layer and the weight of the layer.
Pre = pre-laundered.
$Pst_2$ = post-laundered two cycles.

The basis weight and opacity changes between Example 9 and Comparative Examples 9–10 clearly show that placing the cellulosic layer between two outer layers of filamentous webs significantly improves the durability of the composite. After the laundering cycle, the bonded composite of Example 9 retained its cotton knit-like textural and visual properties, while the unbonded composites developed a large number of holes and sections of uneven fiber coverage.

EXAMPLE 10 (Ex10)

Example 9 was repeated except that the filamentous web was made from crimped monocomponent polypropylene spunbond filaments, the pulp layer had a 33 gsm basis weight and the energy-impact value used was about 0.35 MJ-N/kg. The polypropylene was Shell Chemical's NRD5-1258, and the monocomponent filaments were produced using only one extruder and a monocomponent spinning pack. The crimps in the filaments were imparted by asymmetrically quenching the filaments as they exit the spinning pack. The results are shown in Table 3.

COMPARATIVE EXAMPLE 11 (C11)

Example 10 was repeated except that the filamentous web layers were prepared from crimped bicomponent staple fibers, which has a 3.7 cm length and about 2.5 crimps/cm, and the energy-impact value used was about 0.20 MJ-N/kg. The staple fiber is available from Hoechst Celanese, Corp., and it contains a polyester core and a copolyolefin sheath (Type 255). The staple fibers were carded to form the web layers. The results are shown in Table 3.

TABLE 3

| | Layer Basis Weight (gsm) | | | Total Basis Wt (gsm) | | | Opacity | | |
|---|---|---|---|---|---|---|---|---|---|
| | | | | | | % | | | % |
| Example | $F_1$ | P | $F_2$ | Pre | $Pst_2$ | Change | Pre | $Pst_2$ | Change |
| Ex 10 | 26 | 33 | 26 | 85 | 84 | −1% | 74.5 | 76.5 | 3% |
| C11 | 26 | 33 | 26 | 85 | 80 | −6% | 64.6 | 56.2 | −13% |

Note:
$F_1$ = first filamentous layer.
P = cellulosic layer.
$F_2$ = second filamentous layer.
Pre = pre-laundered.
$Pst_2$ = post-laundered two cycles.

Example 10 was conducted to demonstrate that the filamentous web of the present invention does not have to be produced from conjugate fibers, and Comparative Example 11 was conducted to demonstrate the importance of using continuous filaments.

The bonded composite of Example 10 had cloth-like, more particularly cotton knit-like, textural and visual properties, and these desirable properties were largely unchanged by the laundering cycle as illustrated by the above data. In contrast, during the laundering cycle, Comparative Example 11 lost a large portion of the cellulosic fibers, and the fibers of the composite were rearranged to have uneven bulk and holes.

As can be seen from the above examples, the post-bonded hydroentangled composite of the present invention has high dimensional stability and durability as well as highly desirable cloth-like textural properties, absorbency and breath ability. Consequently, the bonded composite is an excellent material for various applications, especially for skin-contacting applications.

What is claimed is:

1. A launderable composite comprising:

a) a first filamentous layer, said first layer comprising crimped continuous filaments, b) a second filamentous layer, said second layer comprising crimped continuous filaments, and c) a cellulosic layer, said cellulosic layer comprising cellulosic fibers and having been disposed between said first and second filamentous layers, wherein said composite is a hydroentangled pattern bonded composite that is adhesively or thermally patterned bonded forming bonded regions within said composite, and said composite loses less than about 2% of its opacity, based on the initial opacity of said composite, when subjected to one laundering cycle in accordance with the ASTM 2724-87 washing and drying procedure and wherein said first and second filamentous layers are unbonded except by means of said adhesively or thermally patterned bonds.

2. The launderable composite of claim 1 wherein said composite loses less than about 5% of its weight during said laundering cycle.

3. The launderable composite of claim 1 wherein said crimped filaments are selected from monocomponent filaments and multicomponent conjugate filaments.

4. The launderable composite of claim 1 wherein said crimped filaments are spunbond filaments.

5. The launderable composite of claim 1 wherein said crimped filaments comprise at least one fiber-forming thermoplastic polymer selected from polyolefins, polyesters, polyamides, and copolymers and blends thereof.

6. The launderable composite of claim 5 wherein said crimped filaments comprise at least one polyolefin.

7. The launderable composite of claim 1 wherein said crimped filaments are conjugate spunbond filaments comprising polyethylene and polypropylene.

8. The launderable composite of claim 1 wherein said cellulosic fibers are selected from southern pines, northern softwood kraft pulps, red cedar, hemlock, eucalyptus, black spruce and mixtures thereof.

9. The launderable composite of claim 1 wherein said composite is hydroentangled on the both sides of the composite.

10. The launderable composite of claim 1 wherein said composite is pattern bonded with a bond pattern that has substantially uniformly distributed bonded regions and imparts a total bonded area between about 10% and 50% of the total surface area of said composite.

11. The launderable composite of claim 10 wherein said compostie is thermally pattern bonded.

12. The launderable composite of claim 10 wherein said composite is adhesively pattern bonded.

13. A durable hydroentangled composite which comprises two filamentous web layers comprising crimped continuous filaments and a cellulosic layer comprising cellulosic fibers, said cellulosic layer having been disposed between said filamentous web layers, wherein said composite is a hydroentangled pattern bonded composite that is adhesively or thermally patterned bonded forming bonded regions within said composite and wherein said filamentous web layers are unbonded except by means of said adhesively or thermally patterned bonds.

14. The durable composite of claim 13 wherein said composite loses less than about 2% of its opacity and less than about 5% of its weight, based on the initial opacity and weight of said composite, when subjected to one laundering cycle in accordance with the ASTM 2724-87 washing and drying procedure.

15. The durable composite of claim 13 wherein said crimped continuous filaments are monocomponent filaments and multicomponent conjugate filaments.

16. The durable composite of claim 13 said crimped filaments are conjugate spunbond filaments comprising polyethylene and polypropylene.

17. The durable composite of claim 13 said composite is pattern bonded with a bond pattern that has substantially uniformly distributed bonded regions and imparts a total bonded area between about 10% and 50% of the total surface area of said composite.

* * * * *

UNITED STATES PATENT AND TRADEMARK OFFICE

CERTIFICATE OF CORRECTION

PATENT NO. : 5,587,225

DATED : December 24, 1996

INVENTOR(S) : Griesbach, III et al.

It is certified that error appears in the above-identified patent and that said Letters Patent is hereby corrected as shown below:

Column 2, Line 14, "Restor" should read -- Reston --

Column 3, Line 1, "weight based" should read -- weight %, based --

Column 3, Line 2, "mas" should read -- as --

Column 5, Line 53, "incorporated" should read -- Incorporated --

Column 9, Line 1, "A" should read -- An --

Column 9, Line 32, "assist" should read -- assistance --

Column 10, Line 5, "1second" should read --1 second --

Column 11, Line 7, "A" should read -- An --

Column 11, Line 26, "A" should read -- An --

Column 12, Line 9, "A" should read -- An --

UNITED STATES PATENT AND TRADEMARK OFFICE

CERTIFICATE OF CORRECTION

PATENT NO. : 5,587,225

DATED : December 24, 1996

INVENTOR(S) : Griesbach, III et al.

It is certified that error appears in the above-identified patent and that said Letters Patent is hereby corrected as shown below:

Column 12, Line 32, "comparative Example" should read -- COMPARATIVE EXAMPLE --

Column 12, Line 34, "A" should read -- An --

Column 13, Line 27, "2-3,illustrate" should read -- 2-3, illustrate --

Column 14, Line 18, "55 , gsm" should read -- 55 gsm --

Column 15, Line 59, "breath" should read -- breath- --

Column 16, Line 63, "compostie" should read -- composite --

Signed and Sealed this

Twenty-third Day of December, 1997

Bruce Lehman

*Attest:*

BRUCE LEHMAN

*Attesting Officer*

*Commissioner of Patents and Trademarks*